US006253391B1

(12) United States Patent
Watanabe et al.

(10) Patent No.: US 6,253,391 B1
(45) Date of Patent: Jul. 3, 2001

(54) SAFETY SYSTEM AT A DISCHARGE PORT IN A POOL

(75) Inventors: Susumu Watanabe, Hiratsuka; Tomoaki Sumita, Ayase, both of (JP)

(73) Assignee: Nichigi Engineering Co., Ltd. (JP)

( * ) Notice: Subject to any disclaimer, the term of this patent is extended or adjusted under 35 U.S.C. 154(b) by 0 days.

(21) Appl. No.: 09/563,079

(22) Filed: Apr. 24, 2000

(30) Foreign Application Priority Data

Sep. 6, 1999 (JP) ..... 11-251999

(51) Int. Cl.[7] ..... E04H 4/06
(52) U.S. Cl. ..... 4/504; 4/509
(58) Field of Search ..... 4/496, 504, 509; 417/279, 300

(56) References Cited

U.S. PATENT DOCUMENTS 4,620,835 * 11/1986 Bell ..... 4/504 X
5,690,476 * 11/1997 Miller ..... 4/504 X
5,725,359 * 3/1998 Dongo et al. ..... 4/509 X
5,865,601 * 2/1999 Miller ..... 4/509 X
5,947,700 * 9/1999 McKain et al. ..... 417/300 X
6,171,073 * 1/2001 McKain et al. ..... 417/300 X

* cited by examiner

*Primary Examiner*—Charles E. Phillips
(74) *Attorney, Agent, or Firm*—Ostrolenk, Faber, Gerb & Soffen, LLP

(57) ABSTRACT

In a swimming pool in which water is circulated by a pump, a schoolboy child is liable to be absorbed into a discharge port, which is dangerous. A sensor which has a load cell is provided at the back of a water-permeable cover in the discharge port. If a human body of the child is absorbed into the discharge port and contacted with the cover, the load cell is pressed by the water-permeable cover to transmit a signal to a control circuit in which it is determined whether or not pressure variation applied to the sensor is normal or abnormal. If abnormality is determined therein, an alarm is sounded to inform a watcher of the accident and the pump is stopped to release the child from the discharge port.

9 Claims, 3 Drawing Sheets

SAFETY SYSTEM AT A DISCHARGE PORT IN A POOL

BACKGROUND OF THE INVENTION

The present invention relates to a safety system at a discharge port in a swimming pool.

In the swimming pool, water is circulated in the pool and cleaned on the way of the circulation to keep water quality clean and save water.

In the pool in which water is circulated and employed again, a young child such as an elementary schoolchild is absorbed into a discharge port at the bottom so that one is injured or dies.

SUMMARY OF THE INVENTION

The object of the present invention is to provide a safety system at a discharge port in a pool to detect abnormal condition that foreign material such as a human body is absorbed into the discharge port, thereby transmitting a signal to prevent an accident.

In order to achieve the object, according to the present invention, there is provided a safety system at a discharge port in a pool in which water is circulated by a circulating pump, said system comprising a water-permeable cover with which said discharge port is covered; a sensor at the back of said water-permeable cover, having a load cell which is actuated by rearward movement of said cover; a control circuit which is connected to the sensor to determine whether pressure variation applied to the sensor is normal or abnormal; and safety means which is connected to the control circuit, said safety means being actuated by a signal from the control circuit if the pressure variation is determined as abnormal.

BRIEF DESCRIPTION OF THE DRAWINGS

The features and advantages of the invention will become more apparent from the following description with respect to embodiments as shown in the appended drawings wherein.

DETAILED DESCRIPTION OF PREFERRED EMBODIMENTS

Figure 1:
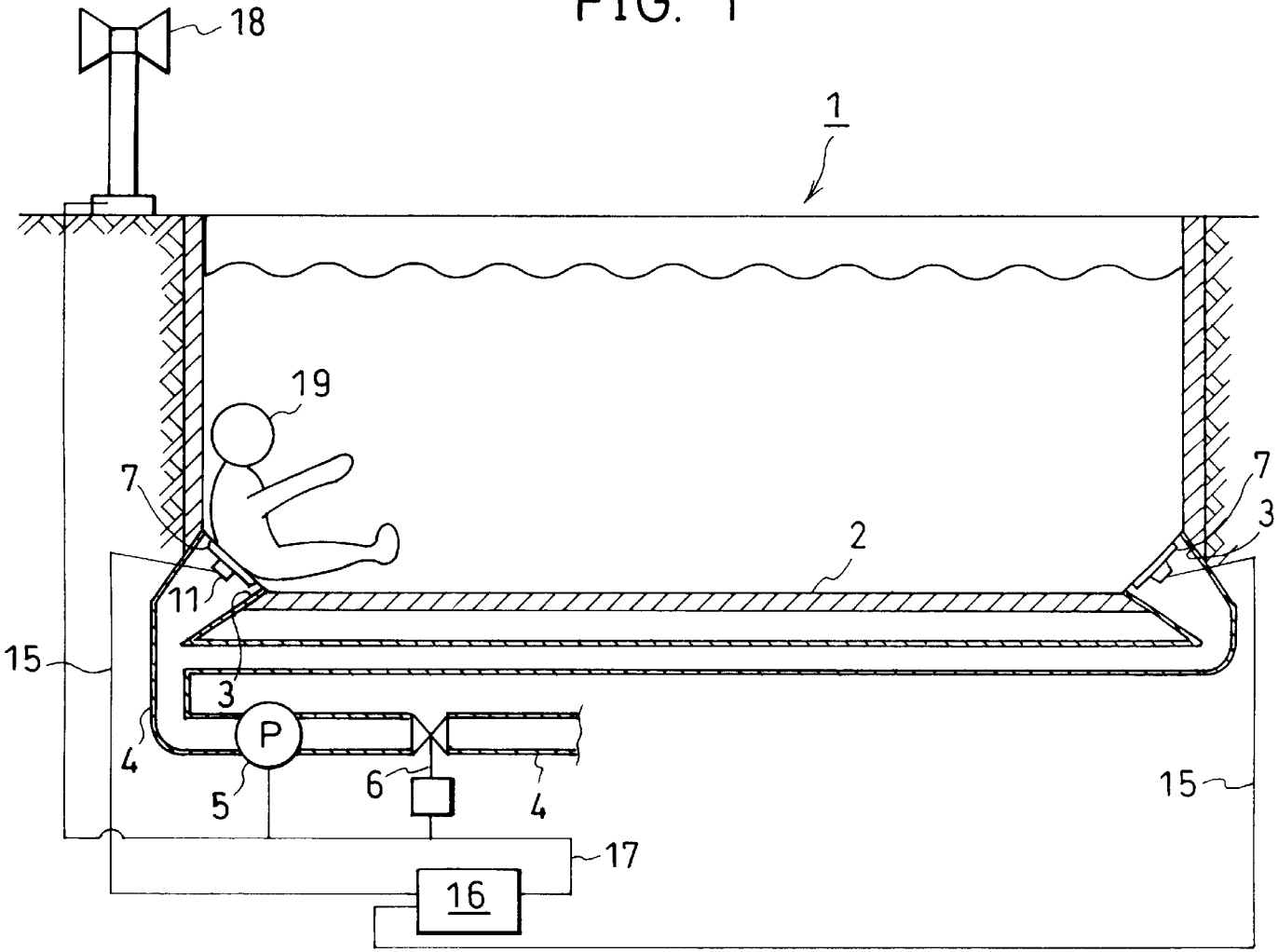
FIG. 1 is a vertical sectional view of a pool which has a safety system according to the present invention at a discharge port of the pool.

FIG. 1 is a schematic view which shows a vertical section of one embodiment of a safety system according to the present invention at a discharge port of a pool, and two discharge ports are formed at corners of a bottom 2 of a pool 1. The discharge ports are connected to a circulating water supply port (not shown) via a tubular path 4 having a circulating pump 5 which is always operated and an emergency shut-down valve 6.

Figure 2:
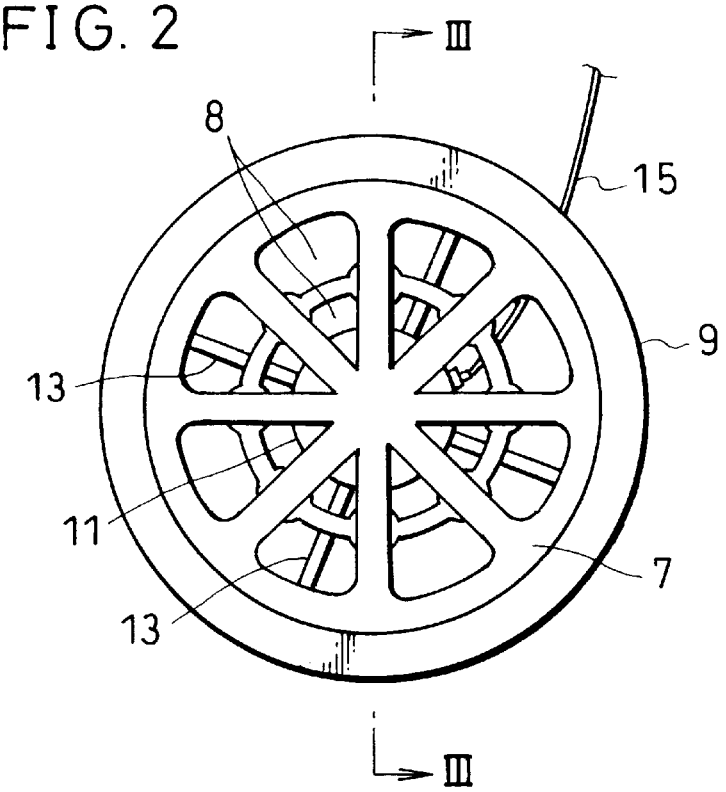
FIG. 2 is a front elevational view of a water-permeable cover with which the discharge port of the pool is covered.
Figure 3:
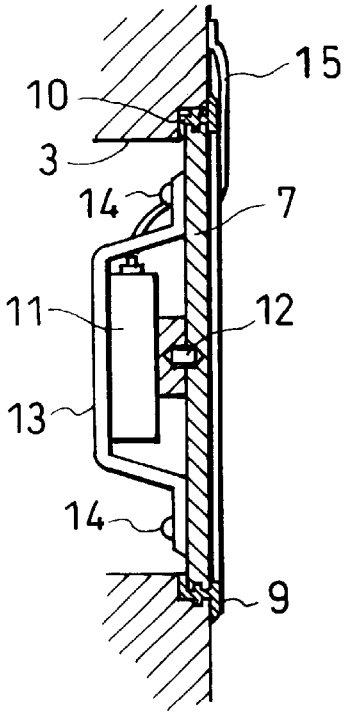
FIG. 3 is a vertical sectional view taken along the line III—III in FIG. 2.

The discharge port 3 is covered with a water-permeable cover 7. As shown in FIGS. 2 and 3, the water-permeable cover 7 is made of flexible material such as a metal and synthetic resin, and comprises a porous or net-like disc which has a number of pores to prevent invasion of the dirt. The cover 7 is mounted to an annular stepped portion 10 around the discharge port 3 via rubber packing 9.

A sensor 11 which has a load cell 12 is supported by a mounting frame 13 in the middle of the rear surface of the water-permeable cover 7, and the mounting frame 13 is fixed to the rear surface of the water-permeable cover 7.

As shown in FIG. 1, the sensor 11 is connected to a control circuit 16 via a cable 15, and an output of the control circuit 16 is connected to the circulating pump 5, the emergency shut-down valve 6 and an alarm 18 via wires 16.

The sensor 11 makes measuring level of the load cell 12 variable depending on capacity of the circulating pump 5, and the control circuit 16 can suitably set pressure range of flowing water during normal operation of the circulating pump 5.

According to the present invention, as shown in FIG. 1, if a human body 19 of an elementary schoolchild or other foreign material is absorbed into the discharge port 3, the water-permeable cover 7 is pressed rearward. So load is applied to the water-permeable cover 7 at once and the discharge port 3 is closed.

Thus, pump-absorbing pressure is applied to only the closed water-permeable cover 7, which is sunken towards the tubular path 4, thereby increasing load to the load cell 12 of the sensor 11 immediately.

Pressure variation at this time becomes very large, and if it is determined as abnormal condition by comparing it with flowing-water pressure normal range in the control circuit 16, a signal is transmitted to the alarm 18 via the wire 17 immediately within one second to inform a watcher of abnormal condition occurrence. A signal is transmitted to stop operation of the circulating pump 5, and/or to close the emergency shut-down valve 6.

As soon as the circulating pump 5 stops, pump-absorbing pressure disappears, and the human body 19 is released from the water-permeable cover 7, and the emergency shut-down valve 6 is closed to generate reverse pressure in the flowing water in two seconds, so that the human body 19 is pressed off the water-permeable cover 7 positively.

If the water-permeable cover 7 with the sensor 11 gets out of the discharge port 3, pressure variation detected by the load cell 12 is compared with normal pressure range in the control circuit 16 to detect abnormality, thereby achieving similar operation.

Figure 4:
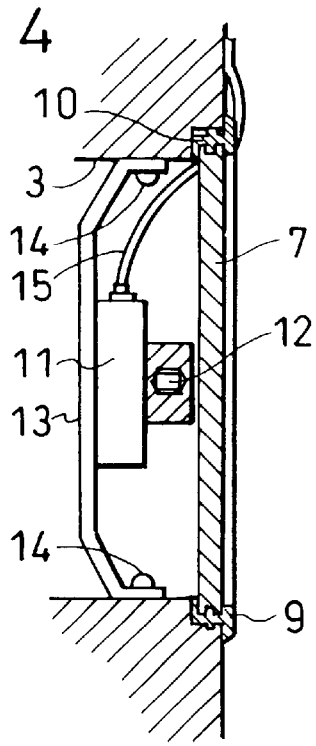
FIG. 4 is a vertical sectional view which illustrates another embodiment of the present invention.
Figure 5:
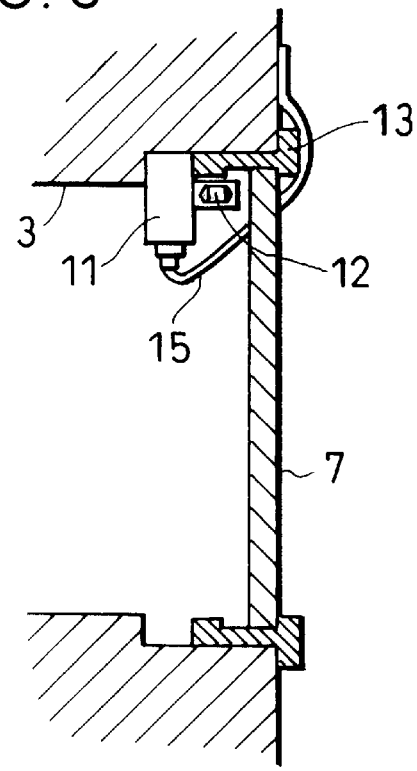
FIG. 5 is a vertical sectional view which illustrates yet another embodiment of the present invention.

FIGS. 4 and 5 illustrate different embodiments of the present invention respectively, similar to FIG. 3.

In the embodiment as shown in FIG. 3, the load cell 12 is connected to the rear surface of the water-permeable cover 7, the sensor 11 which comprises the load cell 12 is directly mounted to the water-permeable cover 7 by the mounting frame 13.

In FIG. 4. a load cell 12 is slightly spaced from the rear surface of the water-permeable cover 7, and a sensor 11 with the load cell 12 is fixed to a mounting frame 13 which is fixed to the inner circumferential surface of the discharge port 3. Since the load cell 12 is spaced from the rear surface of the water-permeable cover 7, pressure applied to the load cell 12 is substantially zero in normal condition, and if the water-permeable cover 7 is deformed in an abnormal condition, the load cell 12 is pressed by the cover 7 to detect pressure at first, thereby facilitating determination of the abnormal condition.

The sensor 11 with the load cell 12 is not directly mounted to the water-permeable cover 7, but separated therefrom, thereby avoiding error in pressure variation detected by the load cell 12 by varying position of the sensor 11 with deformation of the water permeable cover 7 to which the sensor 11 is directly mounted.

In yet another embodiment as shown in FIG. 5, the water-permeable cover 7 is slidably mounted on a mounting frame 13, and the water-permeable cover 7 slides rearwards in an abnormal condition to press the load cell 12, thereby detecting pressure variation. In this embodiment, the water-permeable cover need not be flexible, and relatively low pressure variation can be easily detected.

The foregoing merely relate to embodiments of the invention. Various modifications and changes may be made by person skilled in the art without departing from the scope of claims wherein:

What is claimed is:

1. A safety system at a discharge port in a pool in which water is circulated by a circulating pump, said system comprising:

a water-permeable cover with which said discharge port is covered;

a sensor at the back of said water-permeable cover, having a load cell which is actuated by rearward movement of said cover;

a control circuit which is connected to the sensor to determine whether pressure variation applied to the sensor is normal or abnormal; and safety means which is connected to the control circuit, said safety means being actuated by a signal from the control circuit if the pressure variation is determined as abnormal.

2. A safety system as claimed in claim 1 wherein said water-permeable cover comprises a porous disc made of flexible material such as metal and synthetic resin.

3. A safety system as claimed in claim 2 wherein the load cell is slightly spaced from the water-permeable cover which is mounted to an inner circumferential surface of the discharge port, the sensor with the load cell being mounted to a mounting frame which is fixed to an inner circumferential surface of the discharge port, the load cell being pressed by the cover if pressure is applied to the cover.

4. A safety system as claimed in claim 1 wherein the load cell of the sensor is connected to a rear surface of the water-permeable cover.

5. A safety system as claimed in claim 3 wherein the sensor is supported by a mounting frame which is fixed to the rear surface of the water-permeable cover.

6. A safety system as claimed in claim 1 wherein the water-permeable cover is slidable on a mounting frame and is slightly spaced from the load cell normally, the sensor with the load cell being mounted to an inner circumferential surface of the discharge port, the load cell being pressed by the cover which is slid rearwards on the frame if pressure is applied to the cover.

7. A safety system as claimed in claim 1 wherein the safety means comprises an alarm which informs anyone that the discharge port is under abnormal condition.

8. A safety system as claimed in claim 1 wherein the safety means comprises means for stopping the circulating pump so that absorbing pressure may disappear.

9. A safety system as claimed in claim 1 wherein the safety means comprises means for closing an emergency shut-down valve to generate reverse pressure in the flowing water.

* * * * *